United States Patent [19]

Dorr et al.

[11] Patent Number: 5,000,378

[45] Date of Patent: Mar. 19, 1991

[54] INTRUSION-SECURE MAIL BOX

[76] Inventors: Ray M. Dorr, Box 666, Riverdale, N. Dak. 58565; Gordon J. Michaels, HC-64 Box 318, Trout Run, Pa. 17771

[21] Appl. No.: 153,418

[22] Filed: Feb. 8, 1988

[51] Int. Cl.[5] ..... B65D 91/00

[52] U.S. Cl. ..... 232/17; 232/39; 232/45; 232/43.1

[58] Field of Search ..... 232/17, 39, 27, 31, 232/45, 43.1

[56] References Cited

U.S. PATENT DOCUMENTS

| | | | |
|---|---|---|---|
| 42,052 | 3/1864 | Springer | 232/45 |
| 997,478 | 7/1911 | Toomy | 232/38 X |
| 1,049,058 | 12/1912 | Davis | 232/45 |
| 2,602,584 | 7/1952 | Croft | 232/43.1 |
| 3,735,919 | 5/1973 | Morgan | 232/17 |
| 3,802,619 | 4/1974 | Vanderveer | 232/17 |
| 3,880,344 | 4/1975 | Earle | 232/17 |
| 4,724,999 | 2/1988 | Fitzgerald et al. | 232/45 X |

*Primary Examiner*—Robert W. Gibson, Jr.
*Attorney, Agent, or Firm*—Charles I. Brodsky

[57] ABSTRACT

An intrustion-secure mail box is described as being particularly suited for rural and suburban delivery. A pair of vertically offset doors are provided, through the upper of which mail intended for delivery is inserted, and through the lower of which—lockably openable by the user—the delivered mail is retrieved. A "slide" arrangement is incorporated internal of the mail box—both to direct the delivered mail inserted through the upper door towards the lower door opening, and to act as a bar to prevent an unauthorized retrieval by a person trying to gain access by a reaching through the upper door to get at mail acculumations aggregated at the area of the locked lower door.

6 Claims, 3 Drawing Sheets

INTRUSION-SECURE MAIL BOX

FIELD OF THE INVENTION

This invention relates to mail boxes, in general, and to a mail box which is particularly suited for suburban and rural mail deliveries, in particular.

BACKGROUND OF THE INVENTION

As is well known and understood, mail deliveries in an urban environment are primarily safe and secure. Where apartment buildings are concerned, a bank of mail boxes is generally provided in a lobby area, with the postman gaining access to all the boxes by means of an opening of a single, master door, and with the individual users having their own keys for the accessing of their respective, assigned mail boxes. In office buildings, similar such lock-box arrangements are many times provided—but, by and large, the mail delivery is usually made directly to the concerned office itself, either by the postman actually entering the office, or by delivering the mail through a slot in the office door, or under it. For residential mail delivery, furthermore, delivery is made usually directly at the front door, itself—again, either by placing the mail delivery underneath the front door, or by depositing it in a box adjacent to the entranceway into the house. As will be readily apparent, each of these deliveries is made at a point which is generally the most closest to the intended, final destination.

With suburban and rural mail deliveries, on the other hand, the situation is quite different. While with an office complex, or apartment complex, the mail-delivery situation would be quite analogous to that in an urban environment, the mail box placement is quite different for residential delivery, with the mail box typically being located at the side of the road along which the postman travels in his motor vehicle. As will well be understood, the types of mail boxes almost always employed are of a single-door construction, as approved by the United Stated Postal Service, so that access to the box is just as convenient for an unauthorized intruder as it is for the postman making delivery or for the homeowner retrieving his, or her, delivered mail. With the mail box location at the side of the road often being forty, seventy or even hundreds of feet from the front door of the residence—depending upon front yard setback—the problem of unauthorized entry becomes more severe, as the unauthorized entry is not easily detected as it is happening, and because the location at the roadside makes easy the rapid departure by the unauthorized intruder.

SUMMARY OF THE INVENTION

As will become clear hereinafter, the intrusion-secure mail box of the present invention incorporates a lockable door, analogous to that in an apartment complex which is accessible only by the user. Like with the apartment-type mail delivery arrangement, the mail box of the invention incorporates a second door elevated with respect to the first, which is accessible to the postman but, as contradistinct to the "apartment" mail situation, is not lockable, but is readily openable and closable to anyone who seeks to access it. However, in accordance with the present invention, a slide arrangement is incorporated within the mail box construction—both, to direct the delivered mail from the upper door opening to the front of the lower door opening (so it can be easily retrieved), and to also act as a bar to prevent an unauthorized accessor from reaching through the upper door to get at the mail accumulating for pick-up by the homeowner. As will be seen hereinafter, a preferred embodiment of the present invention incorporates a first slide which extends downwardly towards the rear section of the mail box, and from a point no higher than that of the lower portion of the upper door opening; a second slide is additionally incorporated to extend downwardly from the rear section of the mail box towards a point no higher than that of the lower portion of the lockable, lower door. With the first slide being elevated higher above the ground than the second slide, delivered mail will be seen to traverse the first slide, fall by gravity to the second slide, and then traverse the second slide to accumulate by the user accessible door opening, free from retrieval by an unauthorized intruder trying to get at such mail aggregate by a reaching through the upper delivery door.

BRIEF DESCRIPTION OF THE DRAWINGS

These and other features of the present invention will be more clearly understood from a consideration of the following discussion, taken in connection with the accompanying drawings, in which.

Figure 5:
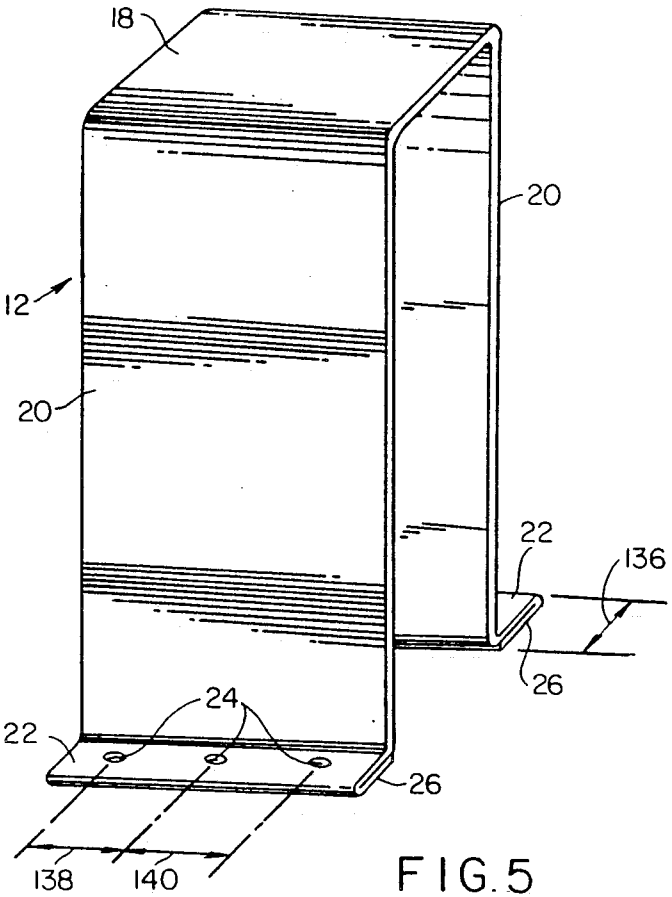
Figure 4B:
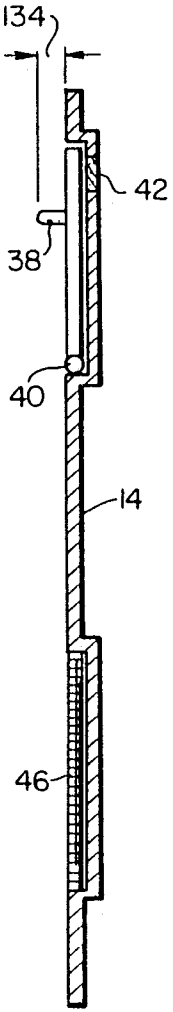
Figure 4A:
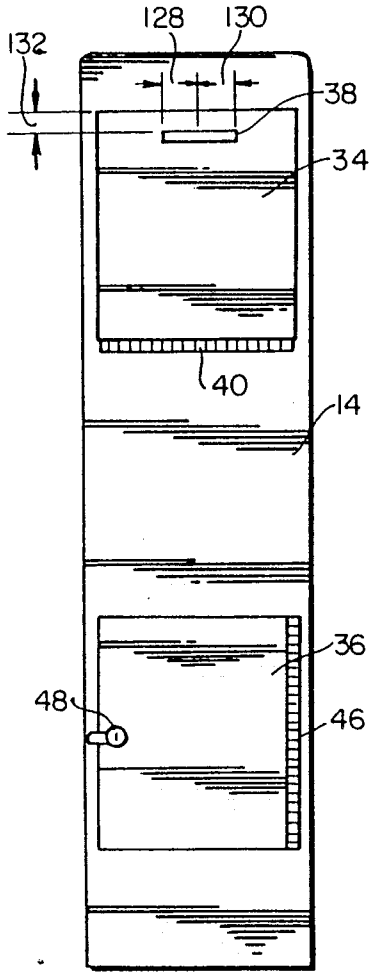

FIGS. *3a–3d* respectively show front, top, side and back panel views of the mail box of the invention;

FIGS. *4a–4b* show front and side views of the front panel of the mail box, helpful in an understanding of the manners by which mail is delivered by the postman and retrieved by the homeowner; and FIG. 5 is a perspective view of a preferred construction, according to the invention, of the side and top panels of FIG. 3, and their manners of fabrication.

DETAILED DESCRIPTION OF THE DRAWINGS

Referring to the drawings, the mail box of the invention 10 incorporates a frame 12 affording a front panel 14, a back panel 16, a top panel 18 and a pair of side panels 20. The side panels 20 are configured to terminate in a flange 22, apertured (as at 24) so as to be mounted for installation by the homeowner to a concrete, wood, or similar such base 26 at the ground location. In a typical installation, three such apertures 24 are provided at each flange location 22, of a $\frac{7}{8}$" diameter for the appropriate acceptance of suitable bolts to secure the mail box against wind, rain, and the other weather elements.

Whereas the back, top and side panels 16, 18, 20 are shown as being of solid, one-piece construction, the front panel 14 is shown as incorporating a pair of openings 30, 32, each of which is closed-off by an openable door—34, 36, respectively. As shown, the door 34 is elevated higher above the ground than is the door 36, and is provided with a handle 38 for grasping in opening the door 34 for the depositing of the delivered mail, as at point A. As is more clearly shown in FIGS. *4a–4b*, the door 34 incorporates a spring loaded roll hinge 40, is fabricated of a metallic material to be held closed between use by an appropriate magnetic closure 42 affixed to the front panel 14, and is configured to fit flush within the opening 30 of the front panel 14 when closed. As will similarly be seen, the lower door 36 likewise includes a spring loaded roll hinge 46, is arranged to fit flush within the opening 32 of the front panel 14, and is releasably lockable (as at 48) by any suitable owner accessible means. In one embodiment of the invention, a ⅜" diameter lucite rod was employed as the door handle 38, being held in place by a washer-nut combination on the back side, and a key lock installation was utilized for the user control 48.

Figure 2:
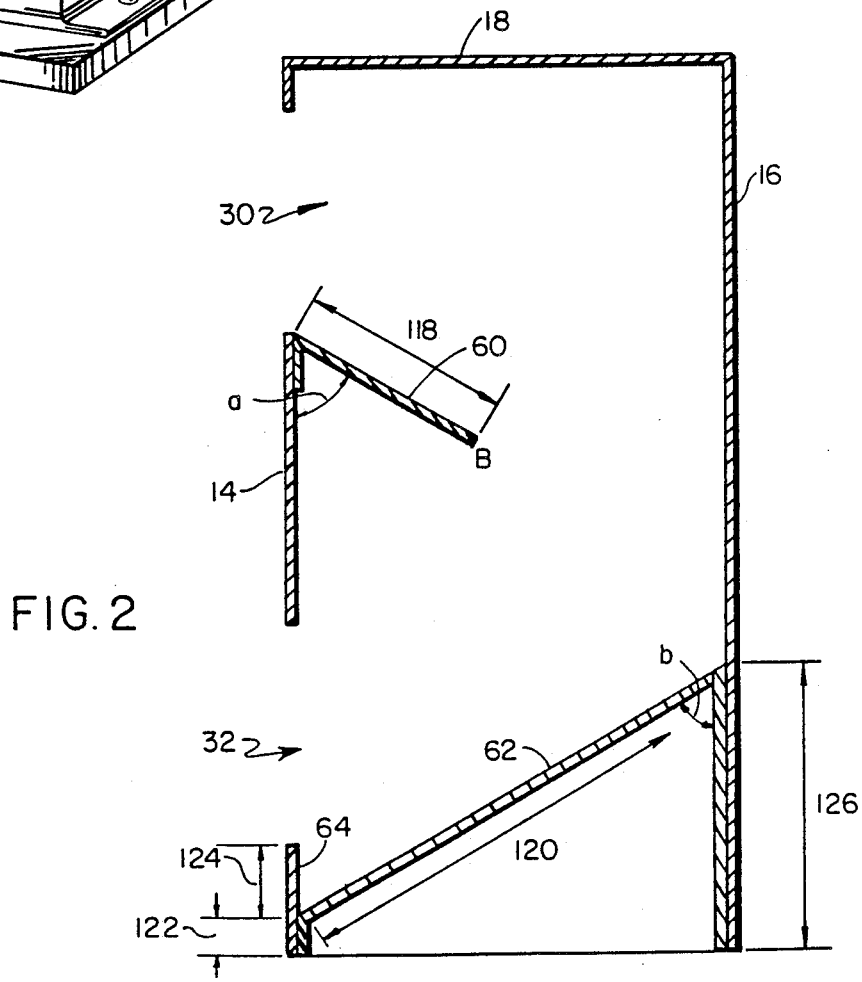
FIG. 2 is a cross-section view of the mail box, helpful in an understanding of the invention.
Figure 3B:
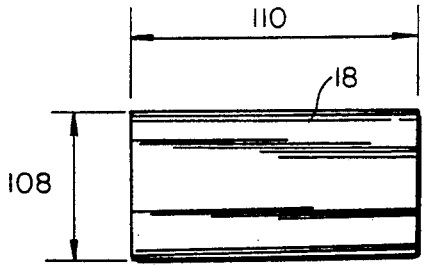
Figure 3A:
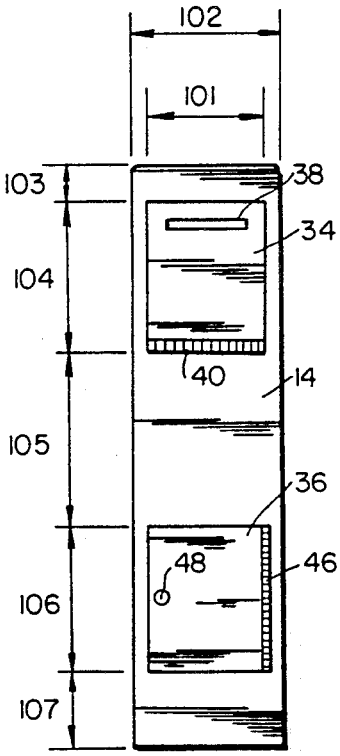
Figure 3C:
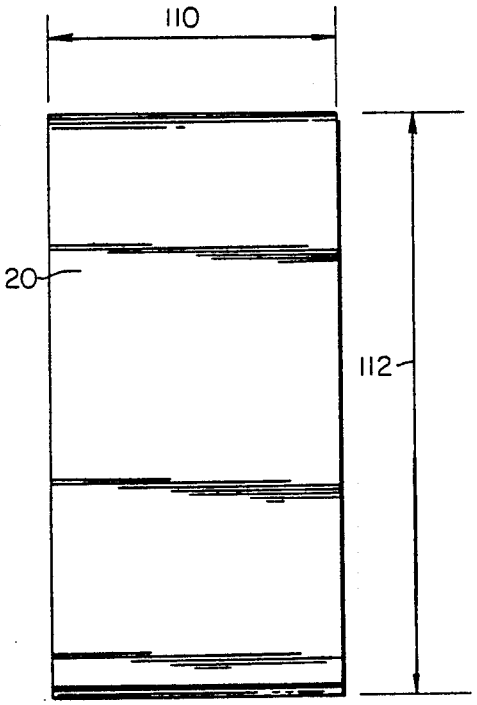
Figure 3D:
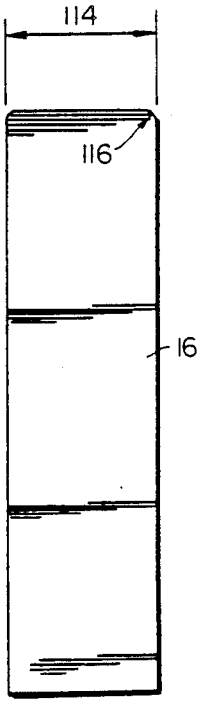

In accordance with a preferred embodiment of the invention, a pair of slides 60, 62 are fabricated internal of the mail box 10 (FIG. 2) to facilitate both the delivery of mail to the user and to make the mail box construction intrusion secure. As shown, the first slide 60 is located inwardly of the mail box enclosure, and extends downwardly towards the inside surface of the back panel 16, and from a point on the inside surface of the front panel 14 which is no higher than that of the lower portion of the closable opening 30. The second slide 62, on the other hand, is similarly located inwardly of the mail box enclosure, but extends downwardly from the inside surface of the back panel 16 towards a point on the inner surface of the front panel 14 which is no higher than that of the lower portion of the closable opening 32. (In the particular construction illustrated, the second slide 62 will be seen to extend downwardly to connect with the front panel 14 at a point some 4 inches below the lower portion of the openings 32, thereby permitting the extension 64 to serve as a "stop" to delivered mail in retaining somewhat the mail against just falling through the opening 32 when the owner accesses the mail by the retrieval opening of the lockable door 36.)

Figure 1:
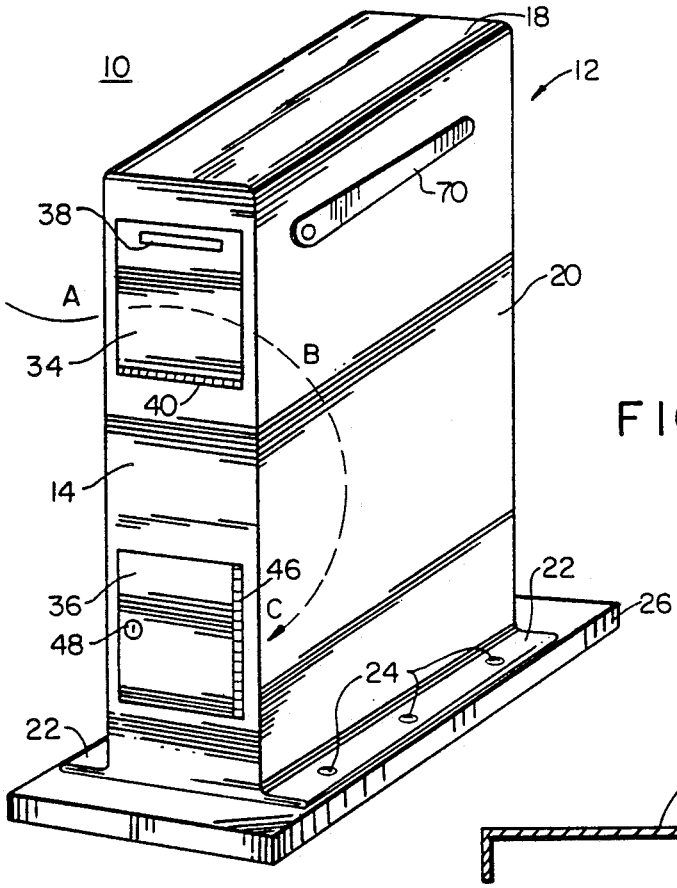
FIG. 1 is a perspective view of the intrusion-secure mail box of the invention as installed by a homeowner.

As will be readily apparent, the slide 60 directs the mail delivered through opening 30 (at point A) into the enclosure, until it falls by gravity (as at point B) to contact the slide 62, and which is then directed by it towards the stop 64 where it accumulates until the desired retrieval by the homeowner. At the same time, it will be seen that the incorporation of the slide 60 serves as a bar to an unauthorized user getting at the mail accumulated at the stop 64, by attempting to reach through the opening 30 in trying to retrieve that which the postman has delivered. The path that the mail delivered through opening 30 then takes is as illustrated by the arrow fancifully shown as A-B-C of FIG. 1, point C being understood to be at that location where the homeowner accesses the mail by means of the door 36. As will also be appreciated, reference notation 70 in FIG. 1 represents a "flag" which can be raised by the postman to indicate that a mail delivery has been made, and which can similarly be used by the homeowner in holding in place mail that he, or she, wishes to be picked up by the postman for delivery elsewheres.

While applicants do not wish to be limited to any particular set of dimensions, the following have provided useful in a preferred construction of the invention in which the mail box panels and slides were made of corrugated steel and of dimensional values to meet United States Postal Regulations for serving as a rural and suburban post box:

Dimension 101: 11 in.
Dimension 102: 12 in.
Dimension 103: 3 in.
Dimension 104: 12 in.
Dimension 105: 15 in.
Dimension 106: 12 in.
Dimension 107: 6 in.
Dimension 108: 12 in.
Dimension 110: 24 in.
Dimension 112: 48 in.
Dimension 114: 12 in.
Dimension 116: ½in. radius
Dimension 118: 11 in.
Dimension 120: 26 in.
Angle a: 60 degrees
Angle b: 60 degrees
Dimension 122: 2 in.
Dimension 124: 4 in.
Dimension 126: 15 in.
Dimension 128: 3 in.
Dimension 130: 3 in.
Dimension 132: 2 in.
Dimension 134: 2 in.
Dimension 136: 4 in.
Dimension 138: 9 in.
Dimension 140: 9 in.

With such dimensions as set forth above, it will be apparent that not only does the mail box of the invention offer the desirable features of being both wind proof and rain proof, it will be seen that the mail box construction offers a large-storage capacity, which permits the safe storage of delivered mail for even extended periods of time, and in a construction which is intruder secure and vandal proof.

While there has been described what is considered to be a preferred embodiment of the present invention, it will be readily appreciated by those skilled in the art that modifications can be made without departing from the scope of the teachings herein. For at least such reasons, therefore, resort should be had to the claims appended hereto for a true understanding of the scope of the present invention. And this, for the simple reason, that whereas the described preferred embodiment has been shown wit the openings 30, 32 being located at positions approximating 33 and 6 inches above the ground, respectively, other elevations may be used equally as well—as long as they satisfy U.S. Postal Service Regulations—and that whereas the slide 60 is of a length almost 50% of the front-to-rear depth of the mail box 10, dimensions of ⅓–⅔ the depth can be used and still provide the intrusion secure feature of the invention. Thus, the true extent of the invention can be seen from the annexed claims which follow.

We claim:

1. A mail box, comprising:

a substantially rectangular enclosure having front, rear, top, side and bottom sections;

a first closable opening located within the front section of said enclosure and adjacent to the top section thereof, and predeterminedly dimensioned for the insertion of letters, envelopes magazines, newspapers and similar such items intended for rural mail delivery;

a second closable opening located within the front section of said enclosure and adjacent to the bottom section thereof, and dimensioned for accessing by a user in retrieving those items as are inserted for rural mail delivery, said second means being releasably lockable;

a first slide means located inwardly of said enclosure, extending downwardly from the front section of said enclosure towards the rear section of said enclosure, and extending at a downward angle from the front section of said enclosure from a point no higher than that of the lower portion of said first closable opening;

a second slide means located inwardly of said enclosure, extending downwardly from the rear section of said enclosure towards the front section of said enclosure, and extending at a downward angle from the rear section of said enclosure towards a point no higher than that of the lower portion of said second closable opening; and means for securing said bottom section to a ground installation to support said enclosure at a height amenable for rural mail delivery;

with said first slide means being of a length insufficient to extend downwardly from the front section of said enclosure to contact the rear section of said enclosure;

with said second slide means being of a length sufficient to extend downwardly from the rear section of said enclosure to contact the front section of said enclosure;

with said first and second closable openings being openable outwardly of said enclosure; and with the lengths and downwardly extending angles of said first and said second slide means being selected to prevent access to delivered items by way of reaching through said first closable opening.

2. The mail box of claim 1 wherein said first slide means extends downwardly towards said rear section from a point at substantially the same level as that of the lower portion of said first closable opening.

3. The mail box of claim 1 wherein the top, side and bottom sections of said enclosure together form a one-piece construction.

4. The mail box of claim 3 wherein said first closable opening is located a distance starting approximately 33 inches above the ground.

5. The mail box of claim 4 wherein said second closable opening is located a distance starting approximately 6 inches above the ground.

6. A mail box, comprising:

a substantially rectangular enclosure having front, rear, top, side and bottom sections;

a first closable opening located within the front section of said enclosure and adjacent to the top section thereof, and predeterminedly dimensioned for the insertion of letters, envelopes, magazines, newspapers, and similar such items intended for rural mail delivery;

a second closable opening located within the front section of said enclosure and adjacent to the bottom section thereof, and dimensioned for accessing by a user in retrieving those items as are inserted for rural mail delivery, said second means being releasably lockable;

a first slide means located inwardly of said enclosure, extending downwardly from the front section of said enclosure towards the rear section of said enclosure, and extending at a downward angle from the front section of said enclosure from a point no higher than that of the lower portion of said first closable opening;

a second slide means located inwardly of said enclosure, extending downwardly from the rear section of said enclosure towards the front section of said enclosure, and extending at a downward angle from the rear section of said enclosure towards a point on the front section of said enclosure at a lower level than that of the lower portion of said second closable opening; and means for securing said bottom section to a ground installation to support said enclosure at a height amenable for rural mail delivery;

with said first slider means being of a length insufficient to extend downwardly from the front section of said enclosure to contact the rear section of said enclosure;

with said second slide means being of a length sufficient to extend downwardly from the rear section of said enclosure to contact the front section of said enclosure at said point below that of the lower portion of said second closable opening;

with said first and second closable openings being openable outwardly of said enclosure; and with the lengths and downwardly extending angles of said first and said second slide means being selected to prevent access to delivered items by way of reaching through said first closable opening.

* * * * *